US009089465B2

(12) United States Patent
Galloway et al.

(10) Patent No.: US 9,089,465 B2
(45) Date of Patent: Jul. 28, 2015

(54) OPEN AREA HARNESS SYSTEM FOR PROVIDING PATIENT MOBILITY

(71) Applicant: University of Delaware, Newark, DE (US)

(72) Inventors: James Cole Galloway, Elkton, MD (US); Ralph D. Cope, Elkton, MD (US); Nanette Gopez, Newark, DE (US); Steven A. Cope, Winchester, VA (US); Tim Braucht, Wilmington, DE (US); Kim Ferrara, Middletown, DE (US)

(73) Assignee: UNIVERSITY OF DELAWARE, Newark, DE (US)

( * ) Notice: Subject to any disclaimer, the term of this patent is extended or adjusted under 35 U.S.C. 154(b) by 0 days.

(21) Appl. No.: 14/173,421

(22) Filed: Feb. 5, 2014

(65) Prior Publication Data

US 2014/0223661 A1 Aug. 14, 2014

Related U.S. Application Data

(60) Provisional application No. 61/760,676, filed on Feb. 5, 2013.

(51) Int. Cl.
*A61G 7/10* (2006.01)

(52) U.S. Cl.
CPC ..... *A61G 7/1042* (2013.01); *A61G 7/1051* (2013.01); *A61G 7/1061* (2013.01); *A61G 7/1078* (2013.01); *A61G 7/1015* (2013.01); *A61G 7/1034* (2013.01); *A61G 7/1048* (2013.01)

(58) Field of Classification Search
CPC ... A61H 3/008; A61G 7/1042; A61G 7/1061; A61G 7/1078; A61G 7/1051; A61G 7/1015; A61G 7/1048; A61G 7/1034
USPC ..... 5/83.1, 85.1, 89.1; 212/71, 76, 78, 84, 212/87, 94, 328, 330, 336, 346, 312, 324, 212/326, 329, 331
See application file for complete search history.

(56) References Cited

U.S. PATENT DOCUMENTS 3,481,582 A * 12/1969 Ulbing ..... 254/331
3,780,663 A * 12/1973 Pettit ..... 104/307

(Continued)

OTHER PUBLICATIONS

LiteGait, "LiteGait the Partial-Weight-Bearing Gait Therapy Device," http://www.litegait.com/litegait.html; 2012, 3 pp.

(Continued)

*Primary Examiner* — Michael Trettel
*Assistant Examiner* — Myles Throop
(74) *Attorney, Agent, or Firm* — RatnerPrestia

(57) ABSTRACT

A gantry system supports a human user in a harness attached to a carriage on a track. The carriage may comprise a body defining a U-shaped or C-shaped opening sized to receive a cylindrical track, and a pair of wheels attached to the body that roll along a top portion of the track with sufficiently minimal drag to permit the user to move the carriage without assistance. Single track embodiments may have a straight or curved trajectory and may have intersecting track portions with junctions that move between the intersecting track portions. In other embodiments, the carriage traverses a perpendicular track spanning a pair of parallel tracks. The perpendicular track may traverse the parallel tracks with or without motorized assistance. A counterweight system may provide partial weight support for the user. In one embodiment, the tracks are supported by a collapsible free-standing structure.

36 Claims, 12 Drawing Sheets

(56) References Cited

U.S. PATENT DOCUMENTS

| | | | | | |
|---|---|---|---|---|---|
| 3,985,082 | A | * | 10/1976 | Barac | 104/89 |
| 4,445,502 | A | * | 5/1984 | Swan et al. | 601/23 |
| 4,545,575 | A | * | 10/1985 | Forjot | 482/69 |
| 4,607,656 | A | | 8/1986 | Carter | |
| 4,648,777 | A | * | 3/1987 | Eichenauer | 414/591 |
| 5,072,840 | A | * | 12/1991 | Asakawa et al. | 212/312 |
| 5,158,188 | A | * | 10/1992 | Nordberg | 212/312 |
| 6,389,618 | B1 | * | 5/2002 | Flynn | 5/81.1 R |
| 6,890,288 | B2 | | 5/2005 | Bingham | |
| 8,215,326 | B2 | * | 7/2012 | Park et al. | 135/145 |
| 8,267,838 | B2 | | 9/2012 | Rasmussen | |
| 8,381,332 | B2 | * | 2/2013 | Fakhrizadeh | 5/89.1 |
| 2004/0217078 | A1 | * | 11/2004 | Keane et al. | 212/71 |
| 2005/0115914 | A1 | * | 6/2005 | Chepurny et al. | 212/328 |
| 2007/0004567 | A1 | | 1/2007 | Shetty et al. | |
| 2008/0271242 | A1 | * | 11/2008 | Hjort | 5/85.1 |
| 2009/0230072 | A1 | * | 9/2009 | Wierzba et al. | 212/324 |
| 2014/0041115 | A1 | * | 2/2014 | Gordon | 5/87.1 |

OTHER PUBLICATIONS

Aretech, "ZeroG-Passive," 4 pp., 2013.

Aretech; Zero-G, "The World's Most Advanced Gait and Balance Training System," 6 pp., 2013.

Hidler et al., Joseph, "ZeroG Overground gait and balance training system," Journal of Rehabilitation Research & Development, 48(4):287-298, 2011.

Biodex, "Biodex Harnesses," www.biodex.com/harnesses; 4 pp., May 2011.

Biodex, "Freestep Sas Harness, Fitting the harness to the patient - a Step-by-Step Guide," www.biodex.com/freestep, 8 pp., Mar. 2013.

Prosser et al., Laura a., "Feasibility and preliminary effectiveness of a novel mobility training intervention in infants and toddlers with cerebral palsy," Dev. Neurorehabil, 15(4):259-266, Mar. 12, 2013.

Rehab Harness; http://www.rehab harness.com/rails-php; 1 p., Dec. 8, 2013.

* cited by examiner

OPEN AREA HARNESS SYSTEM FOR PROVIDING PATIENT MOBILITY

CROSS REFERENCE TO RELATED APPLICATIONS

This application claims priority from U.S. Provisional Application Ser. No. 61/760,676, filed Feb. 5, 2013, which is incorporated herein by reference in its entirety.

BACKGROUND OF THE INVENTION

Patients with severely restricted mobility due to any number of impairments, such as cognitive, strength, balance, postural, coordination, decision making, etc., may require assistive technology (AT) to provide some level of mobility.

Some known AT systems include a multi-wheeled base, usually "U" shaped and intended to traverse a horizontal surface such as a floor, with an attached structure which provides a method to support the user from above. These devices generally are several times the mass of the person being supported, especially in the case of children, and therefore the force required to move the apparatus due to its mass as well as the considerable rolling friction between the wheels and the flooring surface often exceeds the capabilities of the person move the system. In addition, the close proximity of the support structure on three sides of the user typically limits interaction with adjacent articles commonly found in the home, work, and clinic settings, as well as prevents or severely limits, in the case of a child, their ability to play (throw or kick a ball, swing a bat, hockey stick or golf club, etc.) and closely interact with family, therapists, and other children.

Known overhead support rail systems, such as the system depicted in U.S. Pat. No. 8,267,838 may comprise tracks with a generally "C" shaped cross section, with an internal carriage utilizing four to six rolling elements to maintain carriage alignment. Such systems typically limit motion of the user to only the area directly under a substantially straight track and provide fall support, but not weight support (providing a constant or variable upward force to counteract the user's body weight so that the user's legs only have to support a portion of the user's weight when walking).

Other overhead systems are known, such as that shown in U.S. Published Patent Application No. 2007/0004567, in which the tracks resemble standard industrial gantry systems constructed of I-beams. Due to the frictional resistance of multiple rolling elements on the carriage and the mass of the carriage and other moving elements, such systems often include motors and associated controls and sensors on the carriage to provide propulsion of the carriage and user along the rail, and also to adjust and maintain the vertical support for the user as they transition through various elevations (kneeling, sitting, standing, and moving over obstacles).

Some known harness systems are typically only comfortable for the user to wear for a limited amount of time, and may restrict body movement.

Accordingly, there is a need in the field for body support systems that are conducive for use in a community environment or in the home, that can assist users to perform at least some activities of daily living (ADLs) within a wide area of movement, that provide dynamic body weight support not only for walking, but also for vertical movement, that provide greater distance ranges of mobility, and/or that are comfortable for the user to use.

SUMMARY OF THE INVENTION

One aspect of the invention comprises a gantry system for supporting the weight of a human user. The gantry system comprises a first overhead track and a second overhead track spaced apart from and parallel to one another, and a third overhead track perpendicular to the first and second tracks and having opposite ends. A first end of the third track comprises a first carriage configured to ride on the first track, and a second end of the third track comprises a second carriage configured to ride on the second track. A third carriage is configured to ride on the third track with sufficiently minimal frictional drag as to permit the user to move the third carriage along the track without assistance. A harness attached to the third carriage by one or more harness supports is configured to be worn by the user. In some embodiments, the first and second carriages each have a sufficiently minimal frictional drag on the first and second tracks, respectively, to permit a user to move the third track in a direction parallel to the first and second tracks without assistance.

Some embodiments may comprise a collapsible free-standing overhead frame, wherein the first and second tracks are suspended from the collapsible overhead frame in use.

In certain embodiments, the gantry system may further comprise a cord and pulley system attached to a counterweight that provides at least partial body weight support for a user in the harness. In one exemplary system, the counterweight system is configured such that the counterweight moves vertically in response to vertical movement of the user but not in response to lateral movement of the user. In other embodiments, the gantry system may be used only for fall support without a counterweight system.

Some embodiments may further comprise a motorized assembly for translating the third track in a direction parallel to the first and second tracks, and a motor control system configured to move the third track toward a position vertically above the user based upon an angle of deviation of the user from a vertical position below the controller.

Another aspect of the invention comprises a system for supporting the weight of a human user, the system comprising one or more carriages configured to ride on an overhead tubular track having a substantially circular cross section, and a harness attached to at least one of the carriages by one or more harness supports and configured to be worn by the user. Each of the one or more carriages comprises a body defining a U-shaped or C-shaped opening sized to receive the track and to surround a circumferential portion of the track with clearance between the track and the body, and a pair of rolling members attached to the body. Each rolling member is configured to roll along a top portion of the track such that downward forces exerted on the carriage body are translated through the rolling member into a force vector exerted on the top portion of the track. The rolling members are configured to generate a sufficiently minimal frictional drag on the track so as to permit the user to move the carriage along the track without motorized assistance. Each carriage typically comprises a threaded bore extending through the body along a vertical line perpendicular to a longitudinal axis of the track. Carriages for supporting users may be attached to the harness via a fastener attached to the body via the bore. Carriages configured as a movable carriage stop may comprise a threaded fastener located in the bore, the fastener translatable between a first position in which a uppermost end of the fastener has sufficient clearance to permit travel of the carriage stop along the track, and a second position, in which the uppermost end of the fastener is in contact with the track.

The carriage having the features described above may be used in connection with the 3-track gantry system described above or in connection with a single track. Single track embodiments may have a straight trajectory, or may have one or more curves. Single track embodiments may comprise at least a first track portion having an intersection with another track portion, the intersection comprising a junction configured to move between a first position in which a junction track member is aligned with the first track portion and a second position in which the junction track member is aligned with the second track portion.

In one embodiment, the first, second, and third tracks are tubular with a substantially circular cross section, and each of the first, second and third carriages comprise the design described above. In another embodiment, only the third track may have such a carriage design, and the other tracks may have a different design.

DETAILED DESCRIPTION OF THE INVENTION

In its most basic form, the system comprises a system of overhead tracks that provide overhead support to a user, a harness worn by the user and attached to a carriage that enables movement along the tracks, and relationships between tracks that permit movement of the user in an X-Y plane within a room and, optionally, between rooms.

While the device may comprise some electrical components in certain embodiments, other embodiments comprise solely mechanical components. In some embodiments, the system may provide body weight support in a range of 0-100%, more preferably in a range of 0-50%, for a user for a range of horizontal and vertical mobility activities covering a much larger area than along a standard straight or curved track. Accordingly, the system permits a user to sit, crawl, walk, jump, climb, dance, and play sports throughout a room. In other embodiments, the system may permit a user to move between multiple rooms.

In some embodiments, the body weight support remains relatively constant when the user changes vertical and horizontal locations. That is, when the user goes up and down, such as when squatting, moving from a sitting to a standing position, or climbing, or moves forward and backward or side to side, the amount of body weight support remains relatively constant.

A multi-function, long wear harness permits the user to have hands-free, body-weight-supported mobility with a minimum of vertical and horizontal constraints on where and how the user moves. Systems may be used for assisting adult or child users during rehabilitation, ADLs in the home, job training, and on a playground.

Embodiments of the invention comprise light weight, low friction personal support systems suitable for aiding users to walk, play, or accomplish work or normal living activities or to exercise for improving strength and/or balance in a three dimensional controlled area, while providing fall protection and/or partial body weight support. Embodiments may be optimized for use by infants, children, or adults who are physically or mentally incapable of supporting their full body weight.

Some embodiments comprise a minimal number of rolling elements and minimal mass of moving components to facilitate user movement in a horizontal plane under his or her own power. Vertical weight support of the user may be provided in some embodiments by cord-and-pulley systems with a counterweight or by spring or elastic members. In other embodiments, inextensible or elastic connections between the user's harness and the overhead carriage permit a full range of desired vertical motion, yet sufficiently limit undesired vertical motion to preclude falling (i.e. a user's knee touching the ground).

Figure 1:
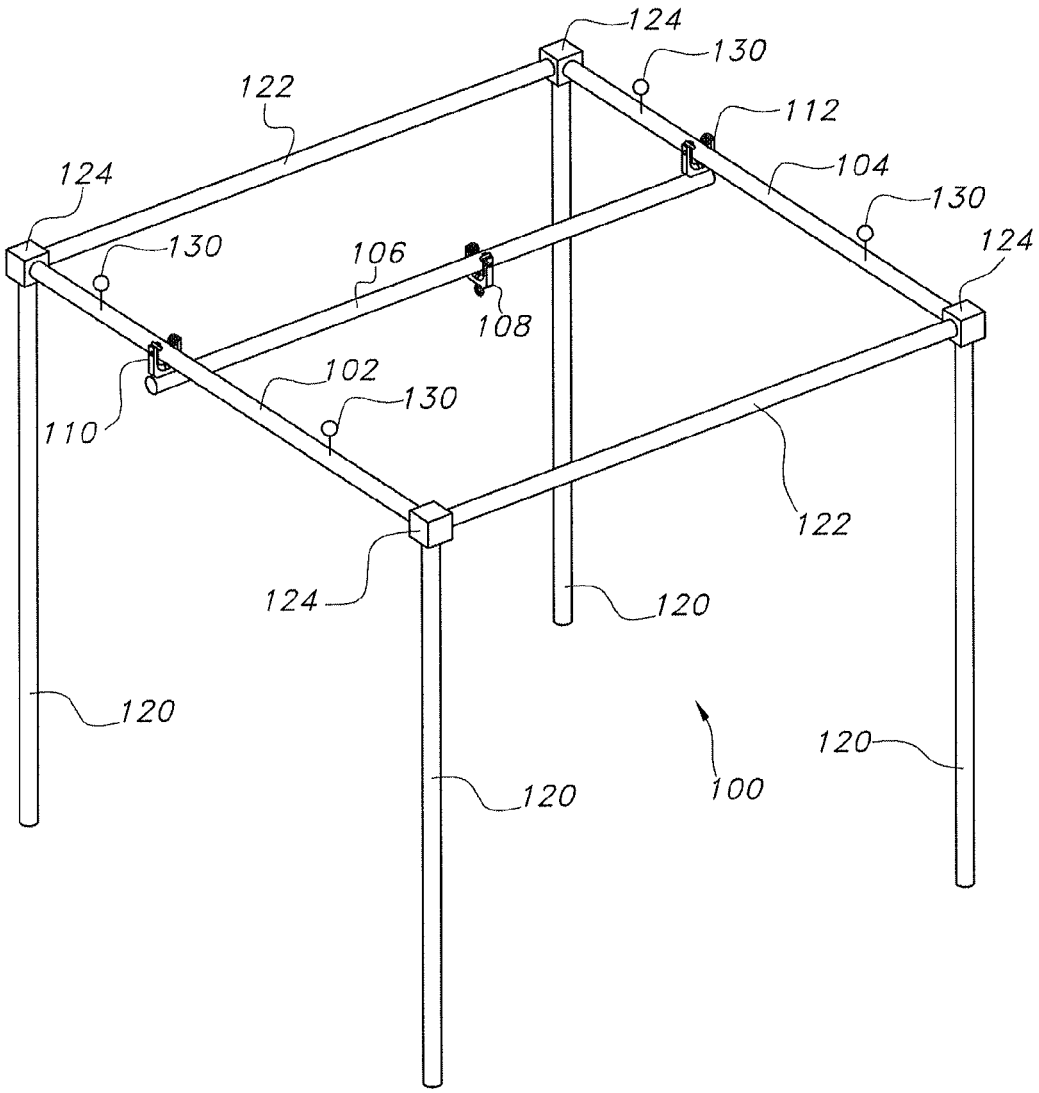
FIG. 1 is a schematic perspective view drawing of an exemplary embodiment of a mechanical-only gantry system featuring tubular tracks, as described herein.

Referring now to FIG. 1, an exemplary system 100 comprises three linear tracks 102, 104, 106 and three carriages 110, 112, 108 that ride on those respective tracks. In one embodiment, best depicted in FIG. 4, track 402 may comprise an enclosed, tubular design having a substantially circular cross section, such as standard 1.5 inch schedule 40 stainless steel pipe with a 1.9 inch outside diameter, or schedule 10 stainless steel pipe with a 2.375" outside diameter, although not limited to any particular size or materials of construction. As used herein, the tubular track is referred to as "substantially circular" to encompass with the scope of the invention tracks that may have a more elliptical cross section, if desired, but as a practical matter, the off-the-shelf availability of standard, circular-cross-section pipe is ideal for use in embodiments of the invention.

Figure 4:
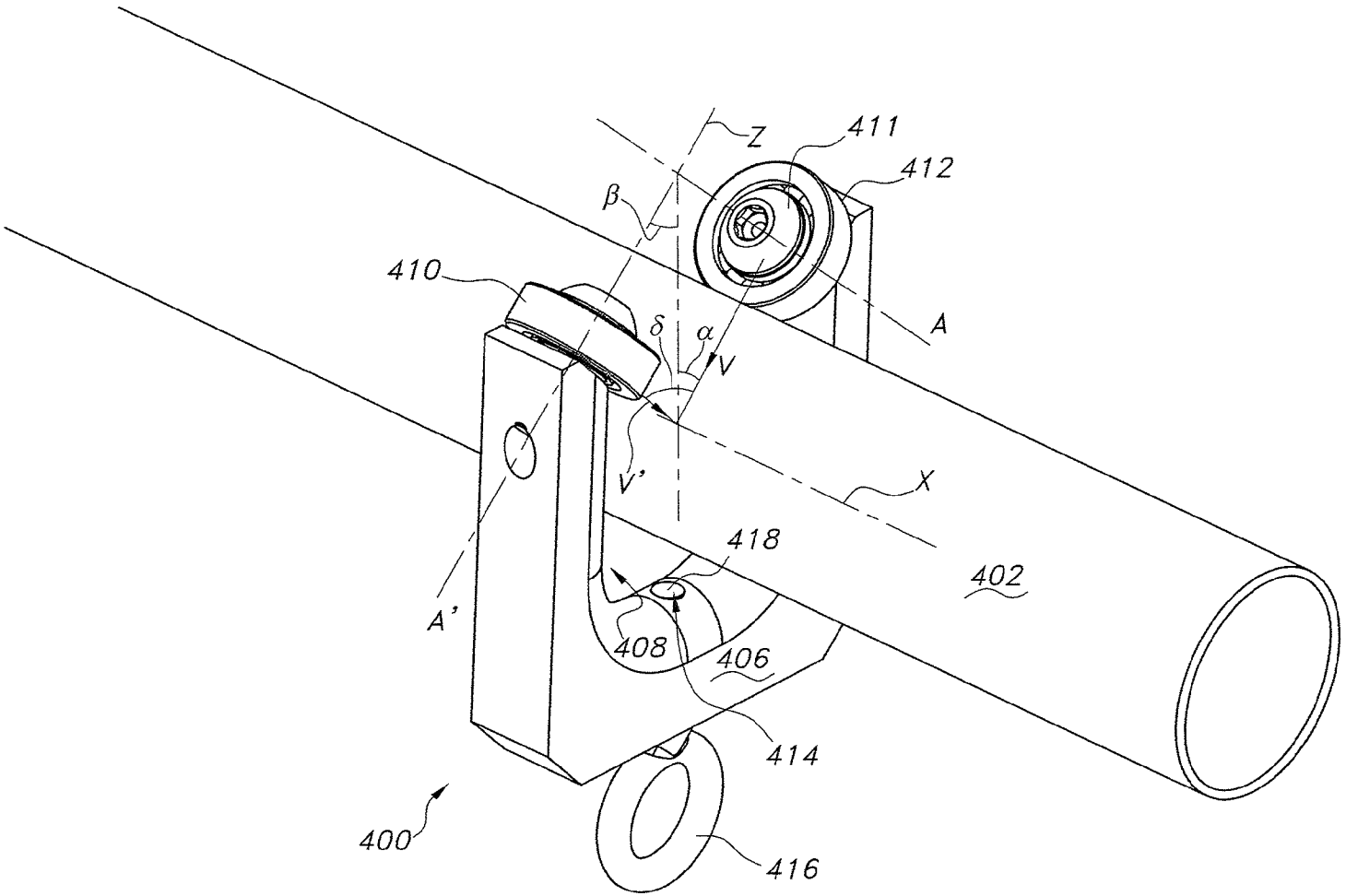
FIG. 4 is a schematic perspective view of an exemplary carriage embodiment for use on a tubular track.

Each carriage 400 comprises a body 406 defining a generally U-shaped or C-shaped opening 408 for receiving the track 402, and two rolling members 410, 412 that ride along an upper portion of the track. In one embodiment (not shown), the body may comprise a section of thick-walled metal pipe into which a C-shaped opening is cut. In other embodiments, such as shown in FIG. 4, a substantially square or rectangular portion slab of metal, such as aluminum, may comprise an opening cut into it. In still another embodiment (not shown), bar stock of sufficient effective diameter (but not limited to any particular peripheral geometry for the bar) may be bent into a C or U shape to provide the body and define the C- or U-shaped opening. The width of the top portion of the opening may be the same as a bottom portion of the opening (hence a "U-shape"), or the top portion of the opening may have a lesser width than a width in a bottom portion of the opening for receiving the track (hence a "C-shape").

In a preferred embodiment, rolling members 410 may comprise wheels mounted on hubs 411 with ball bearings between the inner diameter of the wheel and the outer diameter of the hub, which roll with minimal frictional resistance, such as Model 608ZZ manufactured SKF USA of Landsdale, Pa., but the design is not limited to any particular rolling member design. In the exemplary embodiment, the outer race of the SKF 608ZZ bearing contacts the tubular track, such that part of the bearing itself comprises the wheel that rides on the track. Opening 408 partially encircles track 402, but includes sufficient clearance so that the carriage can move freely. Although not limited to any particular dimensions, it has been found that for tubular track with a diameter of 2.375 inches a clearance of at least 0.125 inches is suitable.

As shown in FIG. 4, rolling members 410, 412 are oriented with their axes of rotation A, A' oriented at an angle $\beta$ of 45 degrees relative to vertical (Z axis) and 90 degrees relative to one another. Axes of rotation A, A' are oriented perpendicular to the respective force vectors V, V' exerted by the members on the surface of track 402, and thus force vectors V, V' are also oriented at an angle $\alpha$ of approximately 45 degrees relative to vertical (axis Z) as shown in FIG. 4. Geometrically, it should be understood that $\alpha=90-\beta$, and that the angle $\delta$ between vectors V and V'=$2\alpha$. Although an angle $\delta$ of approximately 90 degrees has been found most preferable to make the carriage self-adjusting so that it tends to orient itself normal to the longitudinal axis of the track, the invention is not limited to any particular angle. An angle $\delta$ in the range of approximately 45 to 120 degrees is preferred, with an angle closest to 90 degrees being most preferable. Increasing the angle causes greater reaction forces to push outward on the body of the carriage, whereas lesser angles limit the clearance along the top of the track for maneuvering around the members that may suspend the track from overhead in some embodiments.

Orienting the rolling elements at with the angle $\alpha$=approximately 45 degrees for first and second carriages 110, 112, shown in FIG. 1, in particular, has been found to tend to keep track 106 perpendicular to tracks 102 and 104 without racking, and is therefore preferred. The invention is not limited to any particular size or orientation of the opening 408 or rolling members 410, 412. As a safety measure, opening 408 may be sized such that the clearance between the bearing surface of the wheel and the opposite wall of the opening is less than the track diameter, so that carriage will not slip off of the track if one bearing falls off. A design of carriage 400 that is self-centering on the tube, rolls with minimum resistance on the tube, and will not inadvertently disconnect from the support tube if one bearing fails, is preferred. To provide minimum rolling resistance, rolling members may be outfitted with lightweight lubricant (such as WD-40® lubricant manufactured by the WD-40 Manufacturing Company, of San Diego, Calif., or by use of an oil instead of a grease) in the ball bearing chambers.

Thus, in preferred embodiments, the carriage depicted in FIG. 4 comprises aluminum, with low-friction, roller wheels attached to its top, such as roller wheels with a ball bearing hub, with the bearings packed with a lightweight lube to provide minimal rolling resistance. The low-friction bearings, along with the use of strong but lightweight rope in the optional counterweight system, creates minimal drag on the system, thus requiring only a few ounces of force to effect carriage movement along the X-Axis.

Carriage 108 slides on the track 106 between the tracks 102 and 104, and supports the user by means of ropes, straps, springs, or elastic members which extend from the carriage to harness 700, (depicted in FIG. 7), which is worn by the user (not shown).

Systems described herein may comprise one or more carriages 400, including more than one carriage attached to harnesses to carry users, and one or more carriages configured as movable carriage stops. From time to time it may become necessary to limit travel of an individual to only a portion of the track. As shown in FIG. 4, carriage body 406 comprises a vertical bore 414, which is typically threaded to receive the threaded male portion of eyebolt 416, of which only upper end 418 is visible in FIG. 4. When configured as a moveable carriage stop, instead of eyebolt 416, a longer fastener (not shown) may be threaded through the bore such that the upper end 418 is translatable between a first position in which the upper end has sufficient clearance to permit travel of the carriage stop along the track, and a second position, in which the uppermost end of the fastener is in contact with track 402 with sufficient bias to prevent movement of the carriage stop along the track.

In general, first track 102 and second track 104, are arranged parallel to each other and are elevated above the floor by more than the height of the person to be supported, and more typically at a height that permits the area under the tracks to also be traversed by average-height people. Thus, generally the tracks are positioned at least 8 feet off the ground for an adult, but are not limited to any particular height. The first and second tracks 102, 104 are laterally spaced apart from one another, such as by a distance of 5 to 20 feet, and are typically each about 5 to 20 feet in length, although the tracks are not limited to any particular length or spacing. As shown in FIG. 1, the ends of each of tracks 102 and 104 may be attached to legs 120 to create a free-standing structure. Legs 120 are typically laterally braced, such as by braces 122 connecting the first and second tracks. For tracks made of cylindrical pipe, corner fittings 124 may be used for connecting the legs, tracks, and braces together. In an alternate embodiment, first and second tracks 102, 104 can be attached to an overhead structure, such as to the ceiling of the room (not shown) or to another free standing structure (not shown), from at least two suspension points per track, such as eye bolts 130 connected at the top of the tracks. The opening between the rolling members of carriage 400 permits the carriage to roll past such eyebolts without hitting them.

In one embodiment, the first and second tracks may be suspended from to a collapsible overhead structure, such any types of collapsible canopy structure known in the art, such as disclosed, for example, in U.S. Pat. No. 4,607,656, incorporated herein by reference. The design of canopy structure is not of particular importance, other than being sized to support the weight of the user within tolerable factors of safety. The canopy structure may include a covering, such as to protect the user from the elements for outdoor use, or may be used without a covering to provide a transportable superstructure primarily for use indoors (or outdoors in good weather). In the collapsible embodiment, each of tracks 102, 104, 106 may comprise one or more portions that can be connected and disconnected to one another, such as with a slip fitting. A locking mechanism, such as a biased prong on one portion configured to seat within a port in the other portion may be provided, as are well known in the art in connection with cylindrical slip fittings. The tracks may be suspended from the overhead structure using safety latch hooks, carabineers, chains, or the like, that interface with eye bolts affixed to the structure and/or the track. In all embodiments, each track preferably has end caps of sufficient size to provide a physical stop that prevents carriage travel off the end of the track.

Accordingly, the combination of the three tracks as described above permits mobility of the user anywhere within the 3-D rectangular volume approximately defined by the distance between the parallel tracks, the length of those tracks over which the perpendicular track can travel, and the height of the tracks off the ground.

Although described above with respect to a preferred embodiment in which the tracks are tubular, tracks may also comprise an inverted-U-shape or a J-shape (such as is familiarly used as a garage door track) that forms a channel. For example, for an inverted-U-shaped track, the trolley car rides along the X-axis on ball bearings that ride inside the channel formed by the track, such as is disclosed in U.S. Pat. No. 8,267,838, incorporated herein by reference. In such embodiments, each end of the X-Axis rides on ball bearing trolleys inside each Y-axis channel. One end of the X-axis track may have two carriages spaced apart from one another along the Y axis, instead of one carriage, to prevent racking of the X-axis track as it slides on the Y-axis tracks. In non-electrified embodiments, the user powers movement along both the X-axis and the Y-axis.

Exemplary Single Track Designs

The carriage and tubular track configuration described herein may also be used in a single track configuration that extends along a straight or curved path along one or more rooms. In such embodiments, the user is attached via a harness to a carriage that runs on a single track. Although this embodiment lacks the XY mobility of three-track designs, the ease of bending tubular pipe into smooth, curved shapes enables constructions of customized single track designs to meet the needs of a particular user or particular room.

Figure 5:
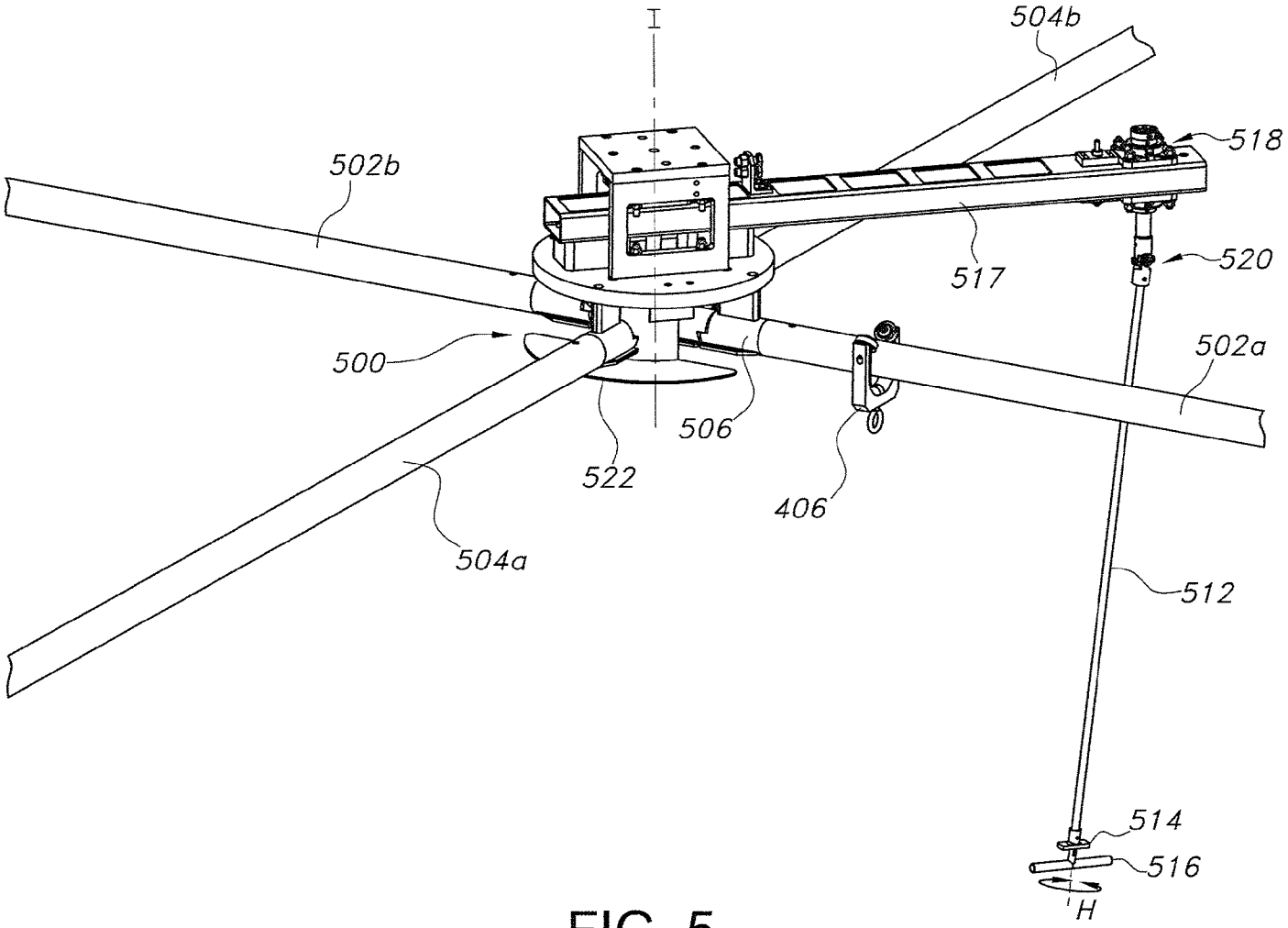
FIG. 5 is a schematic perspective view of an exemplary turntable junction for use with track design having intersections.
Figure 6:
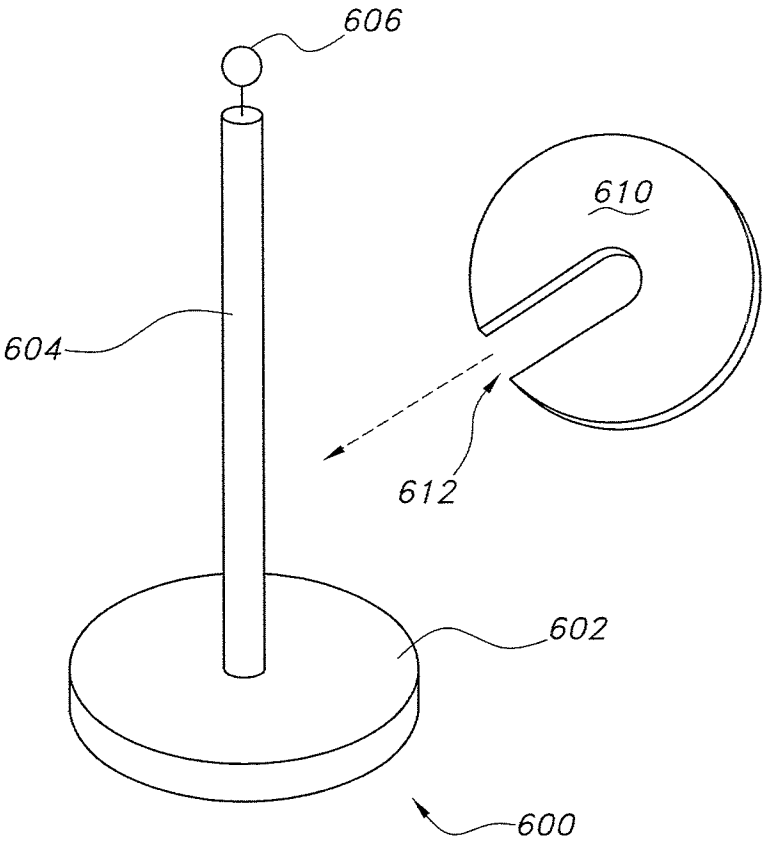
FIG. 6 is a schematic perspective view of an exemplary counterweight stack.

A network of two or more single tracks can be linked together at one or more junctions, such as the turntable junction 500 depicted in FIG. 5. Junction 500 is operable to permit the user attached to carriage 406 to move from a first track 502*a*, 502*b* onto the junction track 506, rotate the junction into alignment with a second track 504*a*, 504*b*, and then continue movement on the second track. In the non-limiting embodiment depicted in FIG. 5, the turntable rotation mechanism comprises a T-handle 516 suspended from a hollow tube 512. Squeezing release mechanism grip 514 and T-handle 516 together causes a cable (not shown) attached to release mechanism grip 514 and running through hollow tube 512 to release a locking latch (not shown). When engaged, locking latch prevents rotation. When the locking latch is disengaged, rotation of T-handle around axis H is transmitted to mechanism 518, which drives a linkage (not shown, located within guard 517), such as a belt, chain or cable, that is attached to a pulley on a shaft that rotates about axis I and turns the turntable. Guards 522 attached to the turntable prevent a user suspended from junction track 506 from inadvertently slipping off during rotation. Guards 522 also act as stops for users on tracks not aligned with junction track 506. In a preferred embodiment, tube 512 may have a hinged connector 520 to permit the tube to be operated from a non-vertical position. Tube 512 is preferably spaced far enough away from the main area under the track that a user does not inadvertently bump it, but close enough that a skilled user can reach it to turn it, if desired. In practice, the portion of the turntable mechanism located vertically above the track may be hidden from sight within a ceiling.

Between Room Mobility

Junctions between different tracks or track portions can be provided anywhere it is desired to have multiple options for travel of the user, such from a track that runs along the periphery of a room to a track that runs inside a room, or to a track that moves between rooms. For movement between rooms, the track can extend through a doorway, including into a bathroom.

The X-Y track systems shown above can also be installed to provide mobility between rooms. For example, the system may be installed such that the parallel rails extend between rooms through a horizontal opening in the wall sized to accommodate movement of the perpendicular track therethrough, and an appropriately sized vertical opening in the wall extending from the door opening to the horizontal opening in the wall.

Counterweight System

Figure 3:
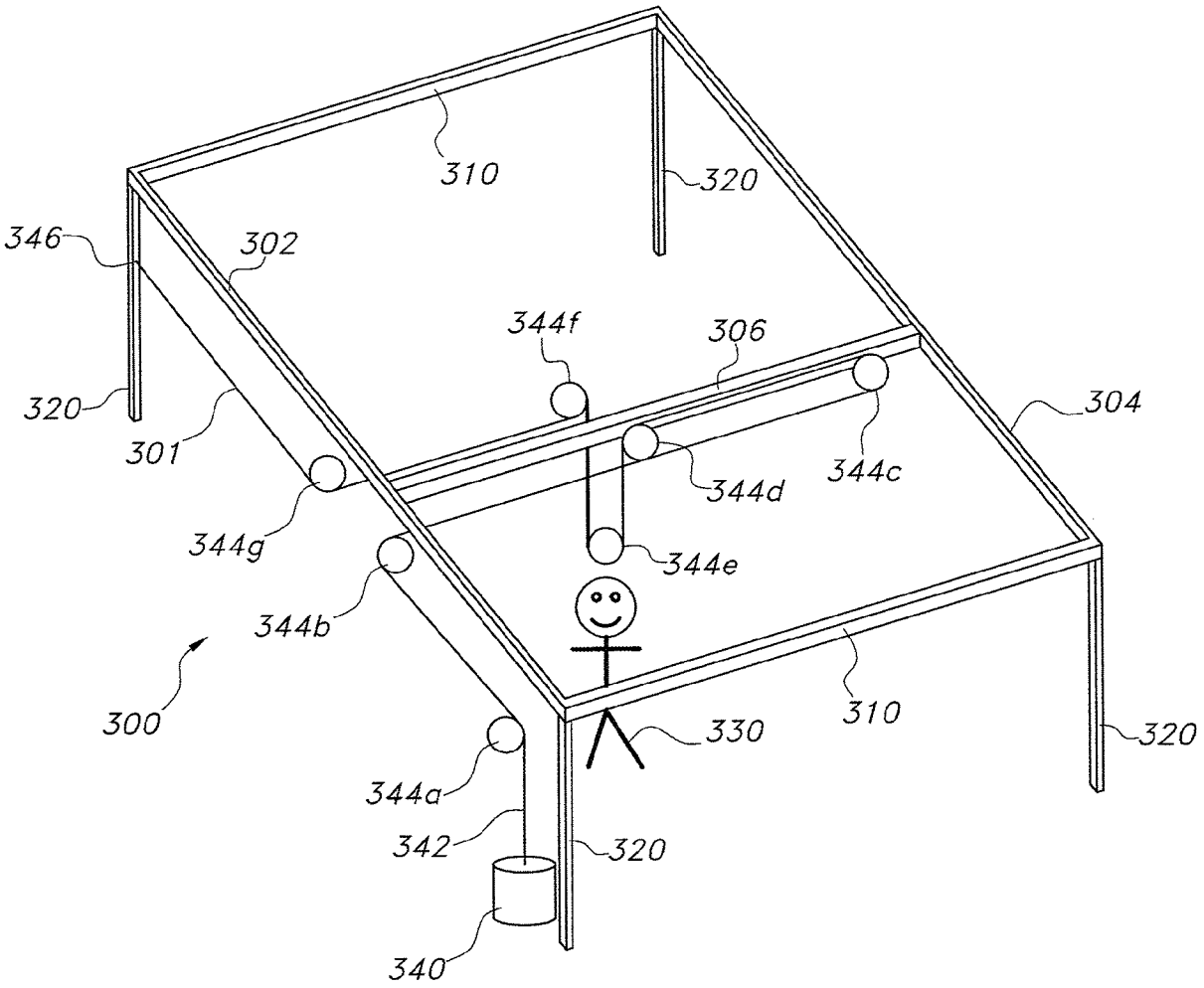
FIG. 3 is a schematic perspective view of an exemplary 1:2 ratio counterweight system.

The two dimensional (XY) gantry system described above may provide body weight support via an optional counterweight system, as depicted schematically in FIG. 3.

The harness may be supported by a pulley and tension member counterweight system 300 to provide at least partial body weight support in which the counterweight moves vertically in response to vertical movement of the user but not in response to lateral movement of the user. In one embodiment, the pulley and counterweight system is attached only to the X-axis track and therefore travels with that track, whereas in another embodiment, depicted in FIG. 3, the counterweight system is attached to the Y-axis track. The amount of body weight that can be supported is adjusted by changing the weights on a counterbalance stack 340. Counterbalance stack 340 may be connected to the harness system in a 1:2 or 1:1 ratio pulley system. In the 1:2 ratio pulley system, such as depicted in FIG. 3, for every inch that the user in the harness moves vertically, the counterbalance stack will move two inches in the opposite direction, and every pound included in the counterbalance stack provides two pounds of weight support for the user. In the 1:1 ratio pulley system, for every inch that the user in the harness moves in the vertical direction, the counterbalance stack will move one inch, in the opposite vertical direction, and the counterbalance provides one pound of weight support for each pound of counterbalance weight.

In the embodiment depicted in FIG. 3, the cord and pulley system 300 comprises an inextensible cord 301 that is fixed at one corner 346 of the gantry system. As depicted in FIG. 3, the gantry system comprises parallel tracks 302, 304, perpendicular track 306, spacers 310 connecting tracks 302 and 304, and legs 320 supporting the gantry system from the floor. Cord 301 extends from the affixation point on corner 346, wraps 90 degrees around a first pulley 344*g* at a first end of rail 306, wraps 90 degrees around a second pulley 344*f* attached to the X-axis carriage (not shown), turns 180 degrees around a third pulley 344*e* attached to the user's harness (not shown), turns 90 degrees around fourth pulley 344*d* attached to the X-axis carriage, turns 180 degrees around a fifth pulley 344*c* at a second end of track 306, wraps 90 degrees around a sixth pulley 344*b* located at the first end of track 306, and wraps 90 degrees around a seventh pulley 344*a* connected to counterweight 340 that is hanging freely.

In another embodiment, pulleys 344*g*, 344*b*, and 344*a* may be eliminated, and cable 301 may be attached to track 306 at approximately the same location where pulley 344*g* is depicted in FIG. 3, with pulley 344*c* oriented such that counterweight 340 hangs therefrom, providing a 2:1 ratio system that travels with rail 306. In a first 1:1 ratio embodiment that travels with track 306, the configuration described above may include another pulley (not shown) that travels vertically with counterweight 340, and through which the tension member wraps 180 degrees and terminates at a fixed location on track 306. Other pulley arrangements may be provided, without limitation.

The counterbalance stack 600 may comprise a circular disc 602 having a rod 604 attached to its center and a hook or eyebolt 606 at its end which allows it to be suspended from the tension member. Circular weights 610 each have a slot 612, extending from their outer diameter to their center, sized to receive rod 604, to permit a user to slide the weights on and off the stack as desired. The amount of body weight supported can be changed by changing the selection and number of weights on the counterbalance stack. Multiple weights of the same size, or a selection of weights of different sizes that permit combinations to achieve nearly any desired total weight, may be provided.

The counterweight system tension member may comprise a metal cable, a non-metal cord, or a line of any material of construction sufficient to bear the forces expected of the system with requisite toughness to withstand the amount of wear and tear. For embodiments powered entirely by the user, however, the inherent bending stiffness of a suitably sized metal cable may lead to an unsuitably high amount of drag. Accordingly, use of a non-metal cord or rope, such as a 3/16" line comprising Ultra-high Molecular Weight Polyethylene (UHMwPE) fibers, such as Dyneema® rope, made by Koninklijke DSM N.V. of the Netherlands, may be preferable to minimize drag. The invention is not limited to any particular tension member materials, however.

Electromechanical Embodiments

Figure 2A:
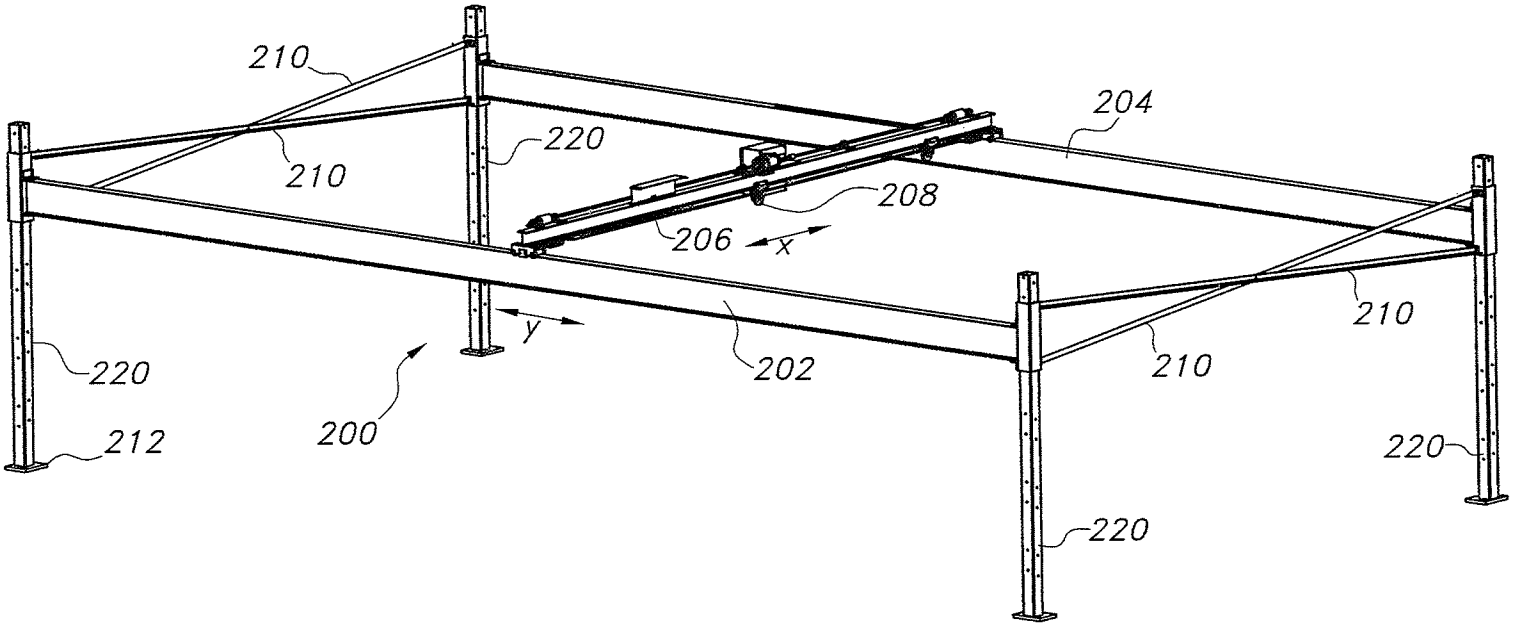
FIG. 2A is a schematic perspective view drawing of an exemplary embodiment of a partially motorized gantry system featuring I-beam tracks, as described herein.
Figure 2B:
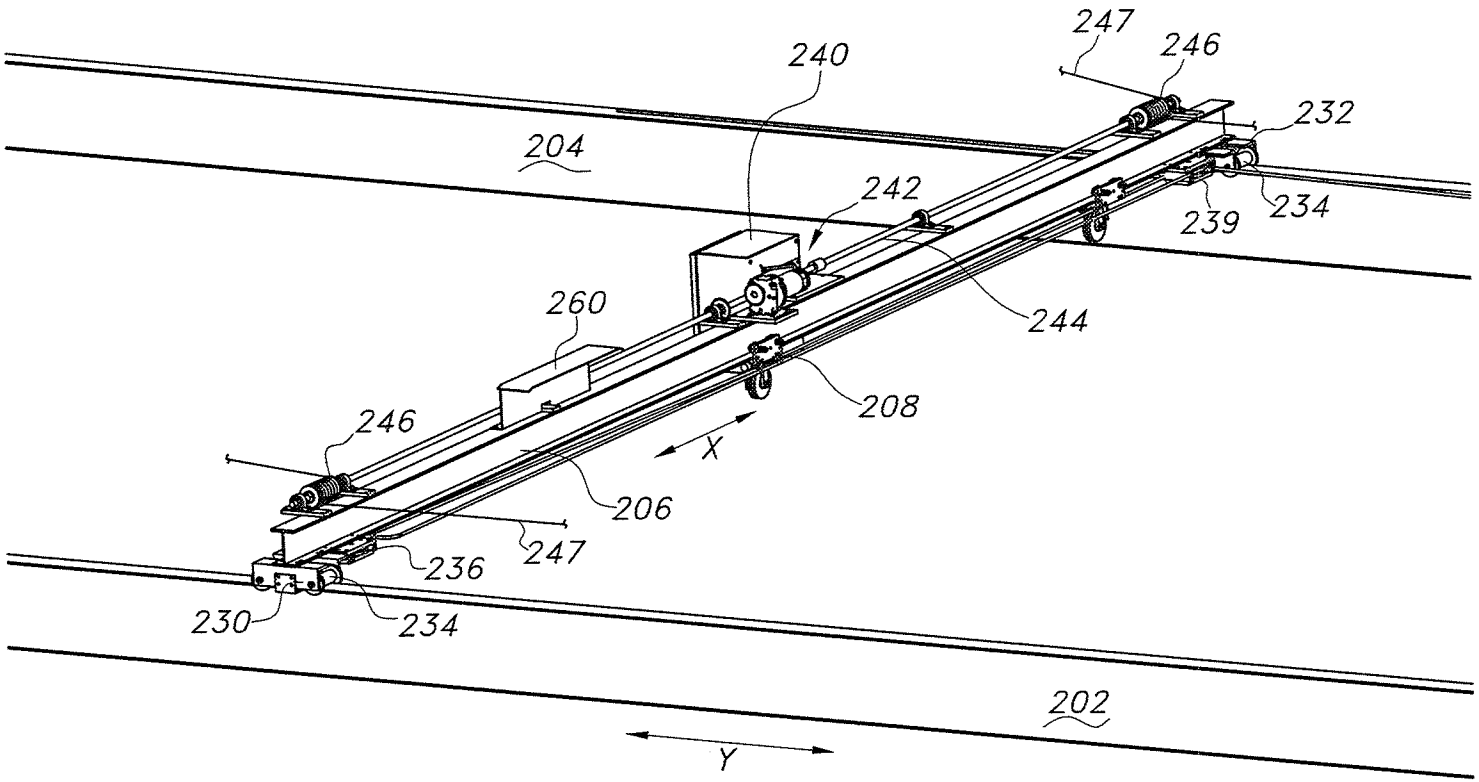
FIG. 2B is a schematic perspective view drawing of a close up view of the X-axis track of the gantry system depicted in FIG. 2A.
Figure 2C:
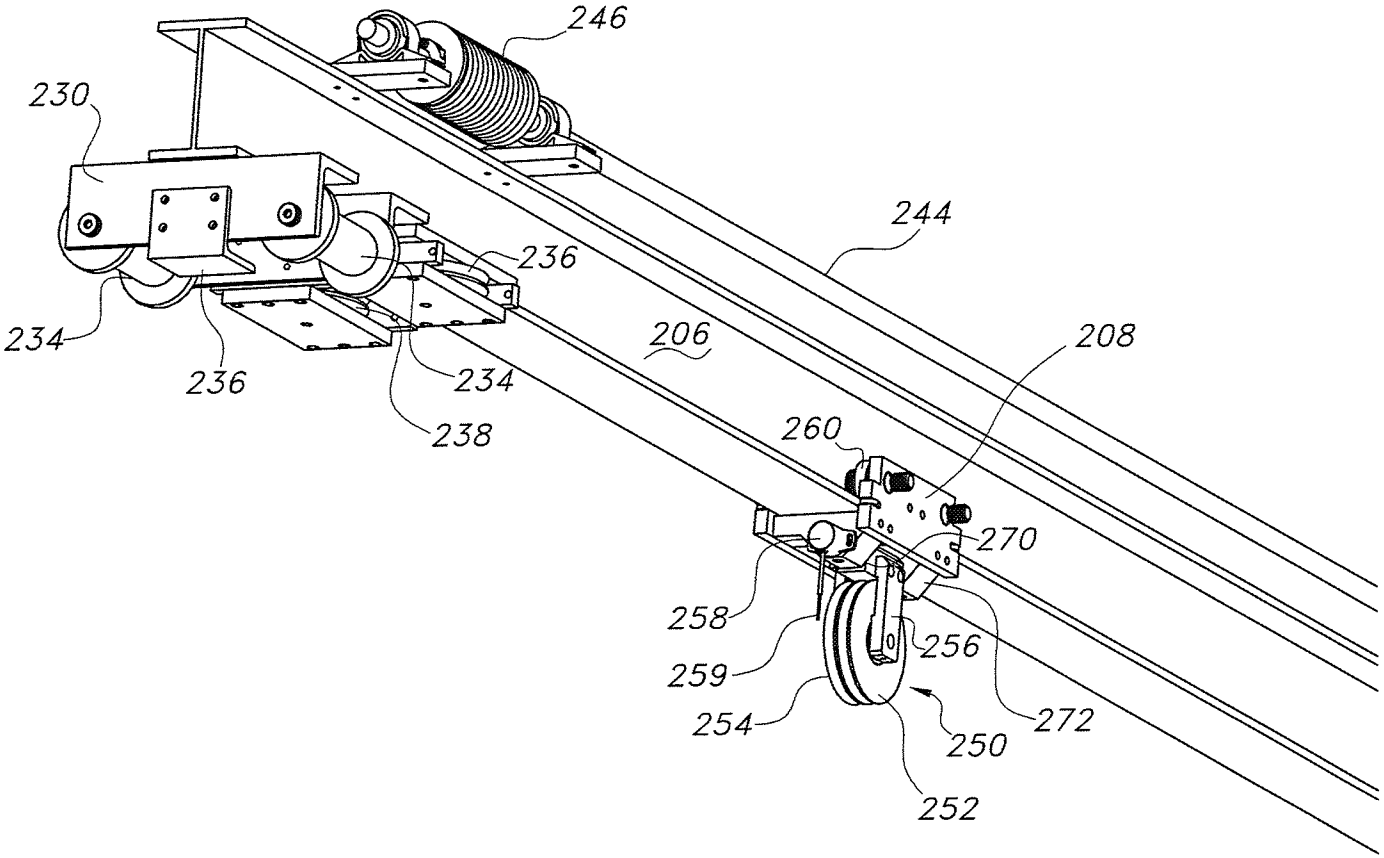
FIG. 2C is a schematic perspective view drawing of a close up view of a portion of the X-axis track of the gantry system depicted in FIG. 2A, showing details of the exemplary carriages.

An exemplary electromechanical embodiment, depicted in FIGS. 2A-2C, like some of the mechanical-only embodiments, comprises a two dimensional (XY) gantry system 200 and a harness (not shown) attached to a cable and counterweight system (not shown in FIGS. 2A-2C) similar to that depicted in FIG. 3. The body weight supported by the harness can be adjusted by changing the weights on the counterbalance stack, similar to the one described above. The counterbalance weight stack is stationary and may be mounted at one corner of the two dimensional gantry system, or may ride with the perpendicular track, as described above.

The harness is supported by a cable and pulley system that is attached to a light-weight, low-friction carriage 208, similar to the overall configuration described above for the mechanical-only embodiment. Carriage 208 is attached to and rides along an X-axis track 206, which may be, for example, an aluminum I-beam, and the X-axis track is attached to carriages at either end that permit it to move along the Y-axis tracks 202, 204, which may also comprise I-beams. Tracks 202, 204 comprising the Y-Axis of the gantry system may be mounted on four vertical supporting legs 220 having feet 212, and may be connected by cross-braces 210.

Because of the mass of the I-beams, a motor 242 provides the motive force for moving X-axis track 206 along the Y-axis. The direction to move the X-Axis track is dictated by a potentiometer 258 mounted to one end of a swivel rod mounted to pulley assembly 250. The swivel rod is attached to the top of the attachment point for the harness. As the user moves in a direction perpendicular to the X-Axis, the swivel rod tilts, causing rotation of the rod on which the potentiometer is attached. This rotation produces a change in the potentiometer signal. The potentiometer signal is fed back to the motor drive, which uses the signal to determine the direction and speed it needs to move the X-Axis. The signal is carried by signal carrier 259, which may comprise a wired connection (in which case only a portion of cable 259 is shown in FIG. 2C, to reduce clutter) or a wireless connection (in which case element 259 depicted in FIG. 2C may comprise an antenna for transmitting a wireless signal). The motor drive effectively moves the X-Axis track to keep the harness system in a vertical position relative to its connection point to the track. If the user moves along the X-axis, they simply pull the trolley with them. If they move along the Y-axis perpendicular to the trolley beam, the motor will drive the trolley beam, essentially eliminating the need for any force input from the user to move the beam in the Y-Axis direction. The user can also move vertically (e.g. climb steps) a limited distance based on the travel of the counterbalance system.

As shown in FIG. 2B, motor 242 drives a shaft 244 having spools 246 attached at each end. Line 247 wrapped around the spools and fixed at opposite ends of tracks 202 and 204 is spooled onto and off of the spools as shaft 244 spins, causing translation of track 206 along the Y axis.

An exemplary carriage 230 configured to ride on track 202 is shown in more detail in FIG. 2C. Carriage 230 comprises rollers 234 for riding on the horizontal top of the I-beam 202, with bracket 236 riding underneath the horizontal top portion. Pulley 236 is equivalent to pulley **344*b* shown in FIG. 3, and pulley 238 is equivalent to pulley 344*g*, shown in FIG. 3. Carriage 232 is essentially a mirror image of carriage 230, except that only pulley 239 (equivalent to pulley 344*c* of FIG. 3) is needed in the embodiment depicted in FIG. 2B**.

Carriage 208 comprises four low-friction ball bearing wheels 260 that ride in the lower horizontal surfaces in the channels formed on opposite sides of the vertical element of the I-beam. Pulley mechanism 250 comprises a first pulley 252 (equivalent to pulley **344*d* of FIG. 3) and a second pulley 254 (equivalent to pulley 344*f* in FIG. 3). Pulleys 252 and 254 rotate freely relative to one another on a shaft supported by brackets 256 that connect the pulleys to pulley block 270. Pulley block is fixed to a shaft (not shown) that rotates within swivel connection block 272. This shaft is connected to potentiometer 258 such that when pulley mechanism 250 deviates from vertical, rotation of the shaft causes the potentiometer to emit a signal that proportionately informs the motor how fast and in what direction to move beam 206 in the direction necessary to return the pulley back to a vertical orientation. Thus, the electromechanical embodiment shown in FIGS. 2A-2C** provides only motorized assistance for movement in the Y direction. The low-friction bearings, along with the use of 3/16" diameter Dyneema® rope for the tension member of the counterweight system, create very little drag, thus requiring the user to exert only a few ounces of force to effect trolley car movement in the X-Axis direction.

The electrical feed for the system may be, for example, 120VAC that can be plugged into any household or industrial 120VAC outlet. An emergency stop system may include one or more, preferably at least two, E-stop pull cord systems (not shown) that run around the perimeter of the four support legs for the gantry system, for safety. The pull cords are preferably mounted above the height, but within arm's reach, of an average adult.

Although depicted with certain carriage embodiments, and certain track constructions, it should be understood that the electromechanical embodiments are not limited to the example shown and described. While preferred embodiments include a counterweight system and are movable by the user along the X axis without motorized support, the invention is not limited to the preferred embodiments.

Harness

Figure 7:
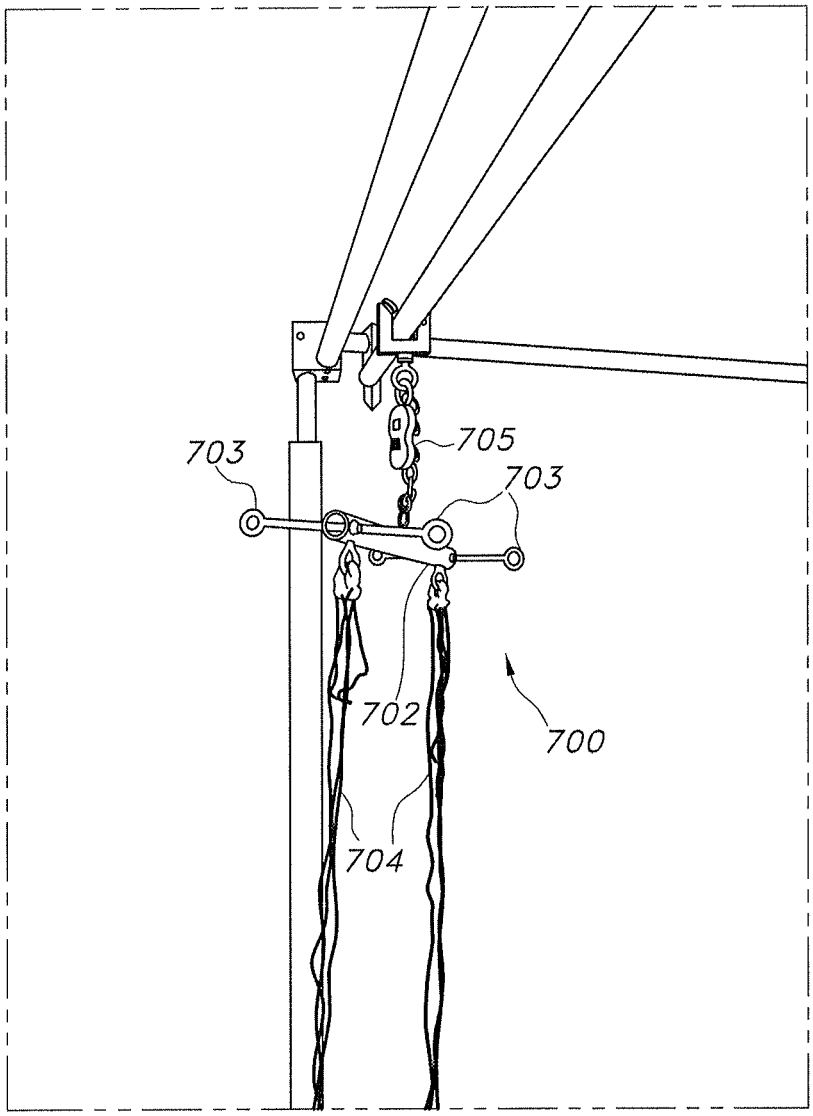
FIG. 7 depicts an exemplary harness support system.
Figure 8B:
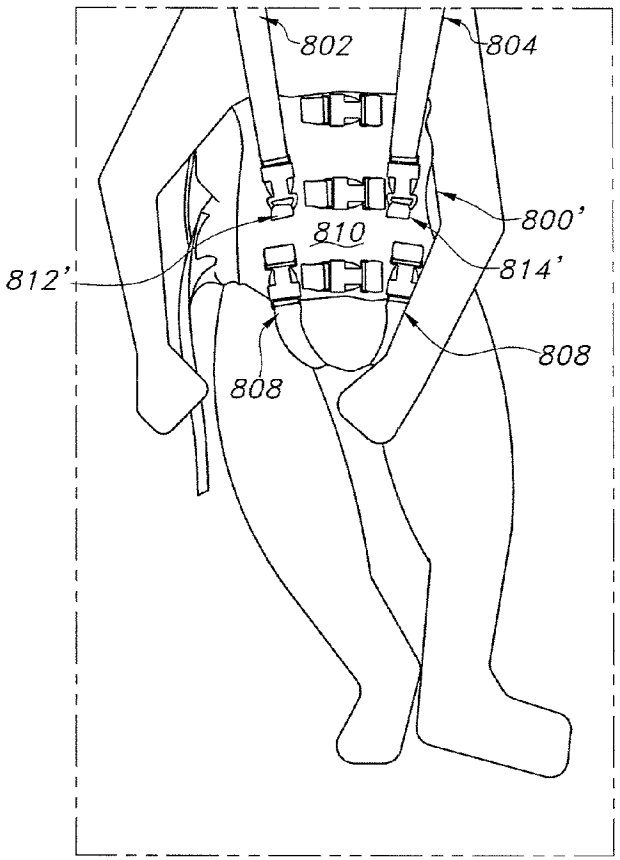
FIG. 8B depicts the exemplary harness of FIG. 8A with the attachment points closer to the user's center of gravity.
Figure 8A:
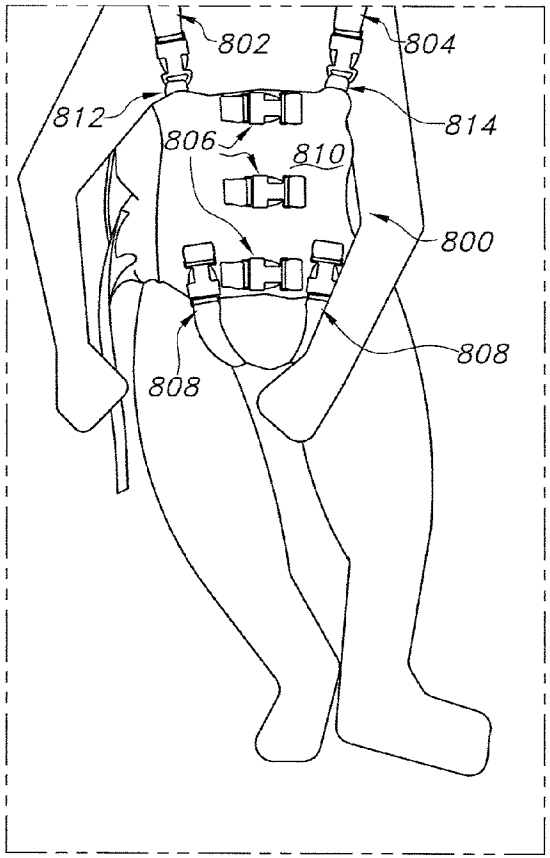
FIG. 8A depicts an exemplary harness having relatively high attachment points.
Figure 9B:
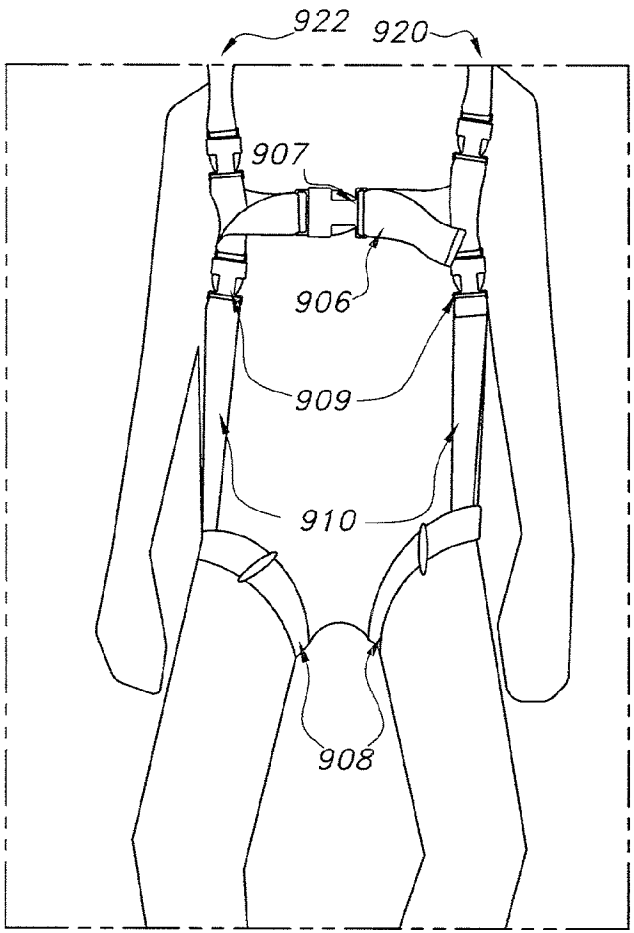
FIG. 9B depicts a front view of the exemplary harness of FIG. 9A.
Figure 9A:
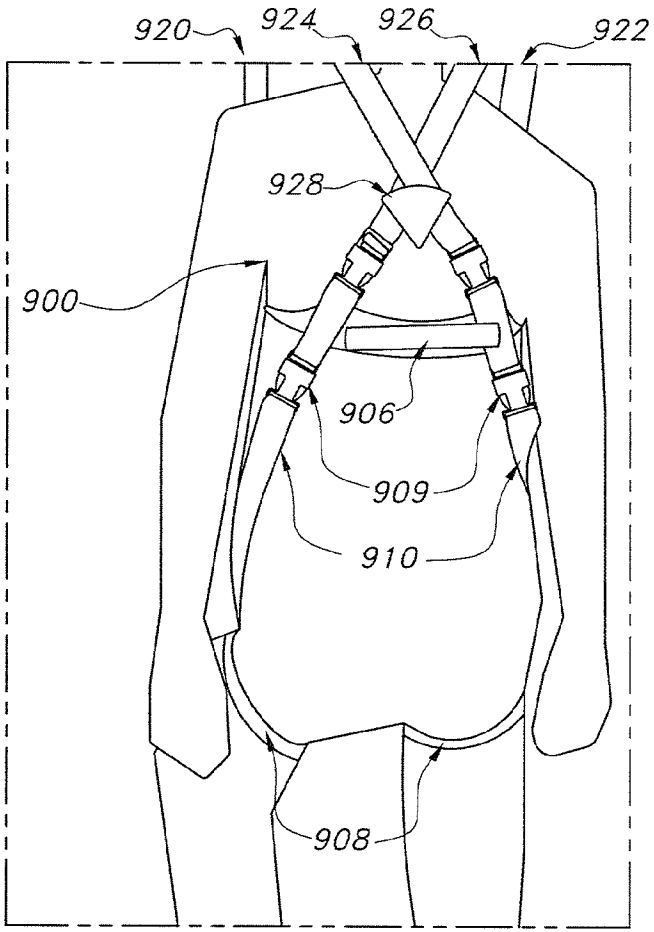
FIG. 9A depicts a back view of another exemplary harness.

An exemplary harness support system 700, depicted in FIG. 7, may comprise a yoke or spreader bar 702 for attachment to the harness via elastic or inelastic harness supports 704 at various attachments points of the harness (not shown). The spreader bar or yoke typically keeps connection members angled away from the user. Yokes or spreader bars with 3 or 4 connections to the user provide more stability, and may be preferred in some embodiments, depending upon the needs of the user. For example, as depicted in FIG. 7, a set of four bungee cords are depicted as harness supports 704 for connecting the yoke (or spreader bar) to the user's harness (not shown). The bungee cords are stretched to provide the desired degree of body weight support and then secured to the end connections 703 at the yoke. Connecting clips may be plastic or metal, and the yoke or spreader bar preferably metal, but neither component is limited to any particular materials of construction. Plastic clips may be preferable for young children users, where the strength of plastic clips have a sufficient safety factor. Adult harnesses designed for up to 400 pound adults, however, typically use metal clips to achieve a desired 5× safety factor for failure load. An exemplary yoke may comprise a bar wrapped in foam with four eye-bolts 703 attached to it, two on each side, such as depicted in FIG. 7, such that each bungee cord has a first attachment point at the center of the yoke on the metal bar, is laced through the attachment points on the harness (not shown), and a second end attached to the eye bolts. The metal yoke is typically attached to a pulley (not shown) at its top center. An scale, in particular an electronic scale, may be incorporated between the harness and the carriage to enable monitoring the amount of lift or body weight support provided to the user, either during use, or during a set-up phase prior to actual use. The cable from the counterweight system is strung through this pulley, thus attaching the entire harness system to the cable balance system and the gantry.

Figure 10:
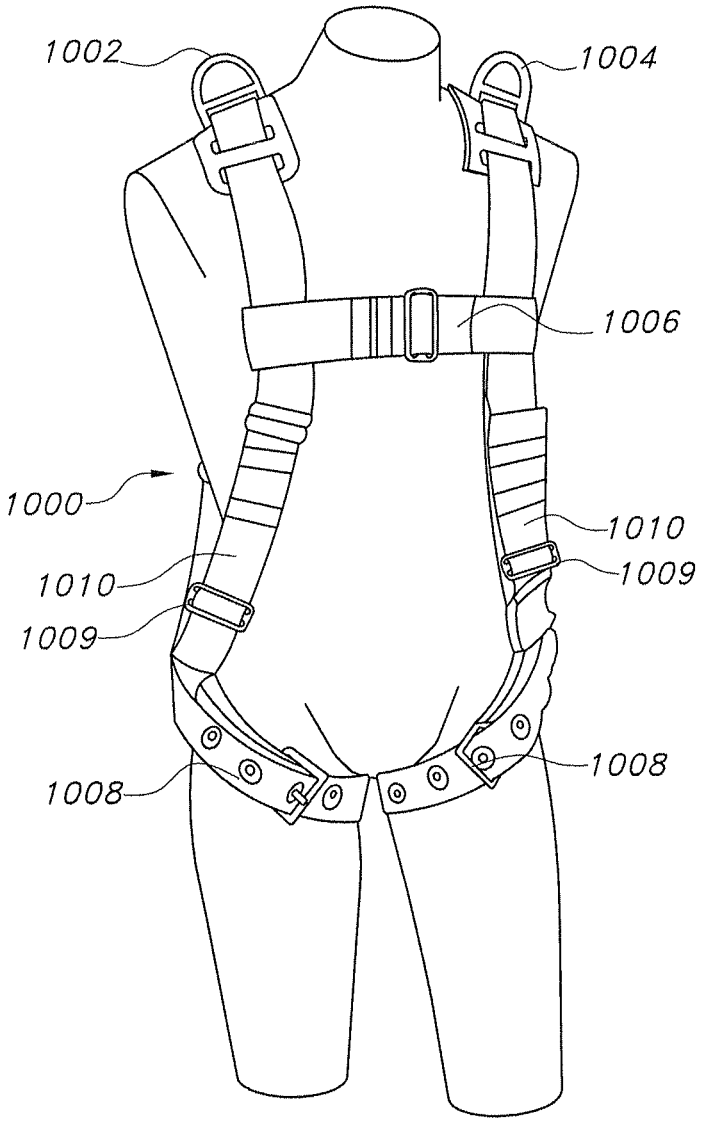
FIG. 10 depicts a front view of an exemplary harness having only two attachment points.

Exemplary harnesses are depicted in FIGS. 8A-10, and may range from harnesses for fall protection, such as the harness design shown in FIG. 10, which may comprise two connection points 1002 and 1004 located typically at or above the user's shoulder, to harnesses for weight support, such as the harness designs shown in FIGS. 8A-9B, which typically have connection points closer to the user's center of gravity, depending on the strength of the user. It should be understood that the various harness designs discussed herein are merely non-limiting examples, and each design is not limited to any particular type of duty (weight support or fall protection), even if characterized as more suited for one or the other.

In general, exemplary harnesses 800, 900, 1000 comprises at least one or more adjustable belts 806, 906, 1006 that supports the user's waist and/or chest, and optionally, adjustable leg straps 808, 908, 1008 attached to the bottom of the harness to provide upper thigh and/or crotch support. Harness 800, shown in FIGS. 8A and 8B, comprises a padded torso support 810 that spans from the user's waist to the user's chest and supports both, with multiple adjustment straps 806 and related buckles. Connecting straps 910, 1010 may connect the crotch and chest supports and are preferably adjustable in length, such as with buckles 909, 1009. In harness designs 800, 800', 900, more ideally suited for weight support, four adjustable straps (802, 804 in FIGS. 8A and 8B); (920, 922, 924, 926 in FIGS. 9A and 9B)—two attached to the front 802, 804, 902, 922 and two attached to the back of the harness belt 924, 926 (not shown in FIGS. 8A and 8B)—connect the harness belt to the metal yoke or spreader shown in FIG. 7. In the embodiment shown in FIGS. 9A and 9B, back straps 924, 926 are preferably crossed at a crossing point 928 between the attachment point to the harness and the attachment point to the metal yoke, to keep the user's hips more stable. This harness is designed for user comfort over a long period of wear and allows for unrestricted mobility, not just simply walking.

In some embodiments, the harness may comprise elastic cords (such as, for example, bungee cords) that can be combined to provide varying amounts of supporting force and adjusted in length to alter the vertical range over which the force is applied. In other embodiments, the harness is connected to the carriage via a relatively inextensible, adjustable length cord that limits how far a user can fall. In still other embodiments, the harness may be connected to the carriage or to the wearer via relatively inextensible adjustable length cords, but may have a first relatively short elastic member interspersed somewhere between the harness and the carriage to limit impact reaction force on the user when the harness is activated (such as when a user stumbles and requires his or her full weight to be supported by the harness). In particular, in single track embodiments, use of one or more elastic members for at least part of the connection between the carriage and the user provides a suitable amount of vertical weight support within a range of force that varies depending upon how far the user moves vertically. The elastic members can be selected to provide relatively minimal resistance for minimal deviation from the normal vertical location, but substantial vertical support when the vertical deviation approaches as fall. This provides the added benefit of providing a significant upward force components to the user at a time when such assistance may be most needed to recover from a stumble or near fall.

As noted above, the harness is preferably configured such that it attaches to the user around the upper legs and the upper body. In other embodiments, however, a chest harness, such as a traction harness or a sailboat harness may be provided that attaches only across the user's chest, but such designs tend to put more stress under the user's arms than embodiments that also support the user's legs and crotch. In certain embodiments, particularly embodiments in which the harness is used primarily for fall protection, an off-the-shelf industrial fall protection harness, such as a Delta Vest Style Rescue Shoulder D-Ring Harness, made by DeltaHarness of Alameda, Calif., attached to a spreader bar, such as a Model 431 Adjustable Heavy Rescue Spreader Bar manufactured by Yates, of Redding, Calif., may be suitable. An exemplary such fall protection harness 1000 is depicted in FIG. 10, and may be connected to the spreader bar at only two points of contact 1002, 1004 vertically above the user's shoulders.

Harnesses may be configured to provide the degree of user mobility desired, such as by modifying off-the-shelf harnesses, as explained further below. In embodiments ideal for providing partial body weigh support, it is desirable, in some embodiments and for some users, for the harness to attach the user to the gantry system at attachment points closer to the user's center of gravity than at the shoulders, because connection at or near the user's shoulders restricts the user from easily being able to lean forward. Connection further down the user's torso, closer to his or her center of gravity, provides more mobility and natural movement. Lowering the attachment points on the harness closer to the center of mass of the body requires the user to exert more upper body strength to control the tilt of the upper body, and more closely simulates the balance required for unaided walking. Thus, a weaker user may require higher initial harness attachment points closer to the shoulders, such as at points 812 and 814 shown in FIG. 8A, and the connection points may be moved lower and closer to the center of gravity, such as at the attachment points 812' and 814' depicted in FIG. 8B, as the user gains strength, such as after repeated use of the systems described herein. The attachment points may be tailored to each user's relative strength and experience walking.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A gantry system for supporting the weight of a human user, the gantry system comprising:

a first overhead track and a second overhead track spaced apart from and parallel to one another;

a third overhead track perpendicular to the first and second tracks and having opposite ends, a first end comprising a first carriage configured to ride on the first track, and a second end comprising a second carriage configured to ride on the second track, the third overhead track comprising a tubular configuration with a substantially circular cross section and a longitudinal axis;

a third carriage configured to ride on the third track, the third carriage configured to ride on the third track and to be moved along the track without motorized assistance, the third carriage comprising:

a body defining a U-shaped or C-shaped opening sized to receive the third track and to surround a circumferential portion of the third track with clearance between the third track and the body;

a plurality of rolling members attached to the body on opposite sides of the opening and configured to roll along the longitudinal axis of the third track in contact with the third track, the plurality of rolling members so configured consisting of a single pair of wheels disposed such that downward forces exerted on the carriage body are translated through the rolling members into respective force vectors exerted on the to portion of the third track; and a harness attached to the third carriage by one or more harness supports and configured to be worn by the user.

2. The gantry system of claim 1, wherein the first and second carriages are each configured to be moved along the first and second tracks, respectively, without motorized assistance.

3. The gantry system of claim 2, wherein the first and second tracks are each tubular with a substantially circular cross section and a longitudinal axis, wherein each of the first and second carriages comprise:

a body defining a U-shaped or C-shaped opening sized to receive the first or second track and to surround a circumferential portion of the first or second track with clearance between the first or second track and the body;

a pair of rolling members attached to the body on opposite sides of the opening, each rolling member configured to roll along the longitudinal axis in contact with a top portion of the first or second track, such that forces exerted on the carriage body by the harness are translated through the rolling member into a force vector exerted on the first or second track.

4. The gantry system of claim 3, wherein the respective force vectors exerted on the first, second and third tracks are perpendicular to respective axes of rotation of the rolling members.

5. The gantry system of claim 3, wherein the respective force vectors corresponding to each pair of respective rolling members are angled relative to one another at an angle in a range of 45 to 120 degrees.

6. The gantry system of claim 5, wherein the respective force vectors corresponding to each pair of respective rolling members are angled relative to one another at an angle of approximately 90 degrees.

7. The gantry system of claim 1 where each of the parallel first and second tracks are suspended at two or more points from one or more structures located over the tracks.

8. The gantry system of claim 1 where the parallel first and second tracks are supported at each end by laterally braced legs to provide a free standing structure.

9. The gantry system of claim 1, further comprising a collapsible free-standing overhead frame, wherein the first and second tracks are configured to be suspended from the collapsible overhead frame.

10. The gantry system of claim 9, wherein the first and second tracks are configured to be detached from the overhead frame for storage and transport.

11. The gantry system of claim 9, wherein the first, second and third tracks each comprise multiple longitudinal portions configured to be assembled together in use and to be disassembled for storage and transport.

12. The gantry system of claim 11, wherein the first, second and third tracks each comprise two components, wherein a first component is configured to be coupled to a second component, the first and second components having an uncoupled configuration and coupled configuration, each track further comprising a locking mechanism to prevent longitudinal separation when locked.

13. The gantry system of claim 12, wherein the locking mechanism comprises a biased prong on the first component configured to be received by a port in the second component.

14. The gantry system of claim 1, wherein the one or more harness supports comprise one or more inelastic members extending from the harness to the third carriage.

15. The gantry system of claim 1, wherein the one or more harness supports comprise one or more elastic members disposed between the harness and the third carriage, the elastic members configured to permit limited vertical movement by the user, the limited vertical movement excluding vertical downward movement sufficient to permit a knee of the user to touch the ground.

16. The gantry system of claim 1 further comprising a cord and pulley system attached to a counterweight that provides at least partial body weight support for a user in the harness, the system configured such that the counterweight moves vertically in response to vertical movement of the user but not in response to lateral movement of the user.

17. The gantry system of claim 16, wherein the counterweight is connected to the user by a pulley and tension member system.

18. The gantry system of claim 17, wherein the pulley and tension member system is attached only to the third track.

19. The gantry system of claim 17, wherein the tension member runs from a first end of the third track, turns 90 degrees over a first pulley attached to the third carriage, turns 180 degrees around a second pulley attached to the user's harness, turns 90 degrees around third pulley attached to the third carriage, and turns 90 degrees around a fourth pulley at a second end of the third track to a connection to the counterweight assembly.

20. The gantry system of claim 19, wherein the connection to the counterweight comprises a fifth pulley and the tension member wraps 180 degrees around the fifth pulley to a fixed connection to the third track.

21. The gantry system of claim 19, wherein the tension member is directly connected to the counterweight assembly.

22. The gantry system of claim 17, wherein the tension member has a first end fixed at a first point adjacent a first end of the first track, and the counterweight is suspended at a second point adjacent a second end of the first track.

23. The gantry system of claim 22, wherein the tension member is fixed at one corner of the gantry system, wraps 90 degrees around a first pulley attached to a first end of the third track, wraps 90 degrees around a second pulley attached to the third carriage, turns 180 degrees around a third pulley attached to the user's harness, turns 90 degrees around fourth pulley attached to the third carriage, turns 180 degrees around a fifth pulley at a second end of the third track, wraps 90 degrees around a sixth pulley attached to the first end of the third track, wraps 90 degrees around a seventh pulley located at the second end of the first track, and is connected to the counterweight assembly.

24. The gantry system of claim 1, further comprising:

a motorized assembly for translating the third track in a direction parallel to the first and second tracks;

a motor control system configured to move the third track toward a position vertically above the user based upon an angle of deviation of the user from a vertical position below the controller.

25. The gantry system of claim 24 further comprising:

a cord and pulley system attached to a counterweight that provides at least partial body weight support for a user in the harness, the system configured such that the counterweight moves vertically in response to vertical movement of the user but not in response to lateral movement of the user.

26. The gantry system of claim 25, wherein the first overhead track and second overhead track are connected to each other by lateral braces and supported by legs to provide a free standing structure, in which the first track, the second track, and the third track comprise I-beams.

27. The gantry system of claim 1, wherein the harness is connected to the third carriage via a connecting system comprising a relatively inextensible, adjustable length member.

28. The gantry system of claim 27, wherein the connecting system further comprises an elastic member disposed between the harness and user the carriage sufficient to lessen impact reaction force on the user when the harness is activated.

29. The gantry system of claim 1, wherein the harness is connected to the third carriage via a connecting system comprising a spreader that distributes a single support from the third carriage to a plurality of user supports, each user support connected to a harness member configured for attachment to the user.

30. The gantry system of claim 29, wherein the harness members are configured for attachment to the user relatively closer to the user's center of gravity than at the user's shoulders and for attachment to the user supports in locations relative to the user that angle the user supports away from a body of the user.

31. A system for supporting the weight of a human user, the system comprising one or more carriages configured to ride on an overhead tubular track having a substantially circular cross section and a longitudinal axis, and a harness attached to at least one of the carriages by one or more harness supports and configured to be worn by the user, the one or more carriages comprising:

a body defining a U-shaped or C-shaped opening sized to receive the track and to surround a circumferential portion of the track with clearance between the track and the body;

a plurality of rolling members attached to the body on opposite sides of the opening and configured to roll along the longitudinal axis of the track in contact with the track, the plurality of rolling members so configured consisting of a single pair of wheels disposed such that downward forces exerted on the carriage body are translated through the rolling members into respective force vectors exerted on the top portion of the track, the plurality of rolling members configured to permit movement of the carriage along the track without motorized assistance.

32. The system of claim 31, wherein the overhead tubular track comprises a single track configured in a straight line.

33. The system of claim 31, wherein the overhead tubular track comprises a single track configured with one or more curves.

34. The system of claim 31, wherein the overhead tubular track comprises at least a first track portion having an intersection with another track portion, the intersection comprising a junction configured to move between a first position in which a junction track member is aligned with the first track portion and a second position in which the junction track member is aligned with the second track portion.

35. The system of claim 31, comprising a plurality of carriages, each carriage further comprising a threaded bore extending through the body along a vertical line perpendicular to a longitudinal axis of the track, a first carriage attached to the harness via a fastener attached to the body via the bore, and a second carriage configured as a movable carriage stop, the carriage stop comprising a threaded fastener located in the bore, the fastener translatable between a first position in which a uppermost end of the fastener has sufficient clearance to permit travel of the carriage stop along the track, and a second position, in which the uppermost end of the fastener is in contact with the track with a sufficient bias to prevent movement of the carriage stop along the track.

36. The system of claim 31, comprising:

a first carriage for supporting the user in the harness;

a first track oriented in a first direction on which the first carriage is configured to run, the first track having a first end connected to a second carriage and the second end connected to a third carriage;

a second track, perpendicular to the first track, on which the second carriage is configured to run; and a third track, parallel to and spaced apart from the second track, on which the third carriage is configured to run.

* * * * *

UNITED STATES PATENT AND TRADEMARK OFFICE

CERTIFICATE OF CORRECTION

PATENT NO. : 9,089,465 B2
APPLICATION NO. : 14/173421
DATED : July 28, 2015
INVENTOR(S) : Galloway et al.

It is certified that error appears in the above-identified patent and that said Letters Patent is hereby corrected as shown below:

In the claims

Column 13, line 26, claim 1, "exerted on the to portion" should read --exerted on the top portion--.

Column 15, line 30, claim 28, "between the harness and user the carriage sufficient" should read --between the harness and the carriage sufficient--.

Signed and Sealed this
Twenty-second Day of December, 2015

Michelle K. Lee

Michelle K. Lee
*Director of the United States Patent and Trademark Office*